United States Patent [19]

Adler et al.

[11] Patent Number: 4,827,179

[45] Date of Patent: May 2, 1989

[54] MASK VIBRATION DAMPING IN CATHODE RAY TUBES

[75] Inventors: Robert Adler, Northfield; Peter C. J. Desmares, Chicago, both of Ill.

[73] Assignee: Zenith Electronics Corporation, Glenview, Ill.

[21] Appl. No.: 59,997

[22] Filed: Jun. 9, 1987

[51] Int. Cl.[4] ..... H01J 29/81

[52] U.S. Cl. ..... 313/402; 313/407; 313/269

[58] Field of Search ..... 313/402, 407, 408, 269

[56] References Cited

U.S. PATENT DOCUMENTS

| | | | |
|---|---|---|---|
| 2,930,918 | 3/1960 | Coffin, Jr. | 313/269 |
| 3,237,094 | 2/1966 | Mitchell | 313/269 |
| 3,638,063 | 1/1972 | Tackikawa et al. | 313/219 X |
| 4,196,371 | 4/1980 | MacGrath, Jr. | 313/269 X |
| 4,318,025 | 3/1982 | Penird et al. | 313/407 X |
| 4,504,764 | 3/1985 | Sakamoto et al. | 313/407 X |
| 4,506,188 | 3/1985 | Puhak | 313/407 X |
| 4,595,857 | 6/1986 | Rowe et al. | 313/407 |
| 4,714,863 | 12/1987 | Yokoyama et al. | 313/269 X |

*Primary Examiner*—David K. Moore
*Assistant Examiner*—Michael Horabik

[57] ABSTRACT

A cathode ray tube which includes a faceplate having on its inner surface a centrally disposed phosphor screen, and a flat color selection electrode supported in tension, spaced from the screen. The electrode has a central apertured portion and a peripheral portion, and is susceptible to vibration. A vibration damping system is located on the peripheral portion of the electrode for damping vibrations in the electrode.

32 Claims, 9 Drawing Sheets

MASK VIBRATION DAMPING IN CATHODE RAY TUBES

FIELD OF THE INVENTION

This invention generally relates to cathode ray tubes and, particularly, to means for damping the resonant mask vibrations in tension mask color cathode ray tubes.

BACKGROUND OF THE INVENTION

As is known in the art, a color cathode ray tube generally is constructed with a glass envelope having a color phosphor screen or layer formed on the inner surface of a panel of the glass envelope. A color selecting electrode is located within the envelope opposing the phosphor screen. An electron beam is emitted from an electron gun located within a neck portion of the envelope, the electron beam being scanned by an electromagnetic deflecting device for impingement on a desired phosphor or phosphors of the phosphor screen.

In conventional color cathode ray tubes having two-dimensionally curved color selecting electrodes or shadow masks, the curvature of the mask and its thickness causes it to be structurally self-supporting. Another type of commercial shadow mask is tensed on a cylindrical support frame and is not self-supporting as is the two-dimensionally curved type. It is used in conjunction with a cylindrically configured phosphor screen. A new type of shadow mask tube has a perfectly flat faceplate and an associated perfectly flat shadow mask. The shadow mask is a very thin foil maintained at a tension of tens of thousands of pounds per square inch. The afore-described cylindrical and flat tension shadow mask configurations are prone to vibrations, as may be caused by external pulses, or by a speaker in an associated television receiver, for example. The resonant frequency of vibration of the mask will vary depending on the mechanical parameters of and tension in the mask. Any vibration of the mask will cause electron beam landings to be out of registry with their respectively associated phosphor elements, causing color impurities in the reproduced images.

Various means have been suggested for damping the resonant vibrations described above. For instance, in U.S. Pat. No. 3,638,063 to Tachikawa et al, dated Jan. 25, 1972, a damping wire or rod is stretched across grid elements of the tube. With such an arrangement, the grid elements are resiliently pressed by the damping rod and, therefore, are not likely to be caused to vibrate by external mechanical shocks or electron beam bombardment. In U.S. Pat. No. 4,504,764 to Sakamoto, dated Mar. 12, 1985, resonant vibrations are damped by making the resonant frequency of at least one aperture grid element of the color selecting aperture grill so as to be different from that of another grid element in the vicinity thereof. It should be noted that with such prior art systems, (1) the grids or grills are cylindrically curved, rather than being flat, and (2) the grill includes a number of parallel band-shaped grid elements. Therefore, with the system of Tachikawa et al, the damping rod can be held against the grid elements because of the curved nature of the cathode ray tube screen. In Sakamoto, the grid elements themselves can be selected of different resonant frequencies. Such solutions to the problem of resonant vibrations are not appropriate with color cathode ray tubes using apertured shadow masks which are flat and in high tension. A damping rod or wire cannot be held in engagement with a flat shadow mask.

More particularly, a tension shadow mask is a rectangular membrane suspended in a high vacuum within the cathode ray tube envelope under high mechanical tension. The shadow mask is flat and, therefore, is capable of vibrating in so-called "membrane modes," i.e., the two-dimensional equivalent of the vibrations of a stretched string. This type of vibration is defined by the fact that the restoring force due to stiffness is negligible compared to that due to tension. The most prominent membrane mode is the fundamental one, with maximum amplitude in the center of the shadow mask. Elsewhere, the amplitude is a sinusoidal function of position. It is readily apparent that prior art mask damping devices, such as damping wires stretched in engagement with a cylindrically curved grill, are ineffective for use with a flat tension shadow mask. This invention is directed to providing a solution to the problem of damping resonant vibrations in a flat tension shadow mask.

OBJECTS OF THE INVENTION

It is a general object of the invention to provide, for use in a color cathode ray tube having a color selection electrode supported in tension, means for avoiding a deterioration of picture quality caused by external vibrations.

It is another object of this invention to provide for use in a color cathode ray tube a color selection electrode supported in tension and vibration damping means for damping vibrations in the electrode.

It is an important object of this invention to provide such vibration damping means which maintains its effectiveness in spite of significant changes in the resonant frequency of the color selection electrode which may result from heating and cooling of the electrode.

It is another object to provide such vibration damping means which does not occupy any portion of the scanned active area of the electrode and which therefore casts no shadow on the picture area of the screen.

It is yet another object of the invention to provide such vibration damping means which is low in cost, easy to install and is not apt to damage a fragile foil electrode.

It is still another object to provide such vibration damping means which is able to withstand the high temperatures encountered during tube processing and is compatible with the vacuum environment within a cathode ray tube.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENTS

Figure 1:
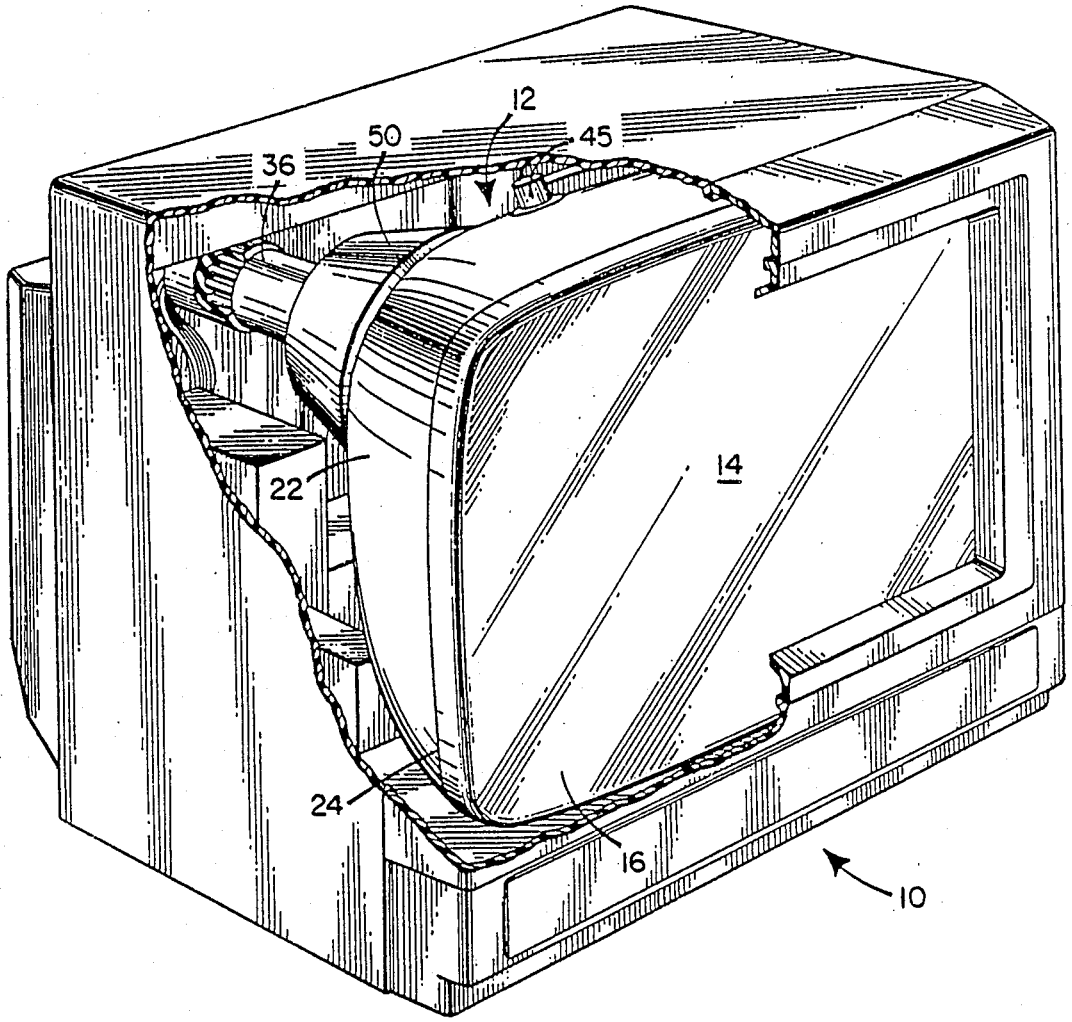
FIG. 1 is a cut-away view in perspective of a cabinet that houses a cathode ray tube and showing major components relevant to the disclosure.

With reference to FIG. 1, there is shown a video monitor 10 that houses a color cathode ray tube 12. The design of the video monitor is the subject of copending design patent application Ser. No. 725,040, of common ownership herewith. The tube could as well be contained in a television console of the home entertainment type. The tube 12 shown is notable for the substantially flat imaging area 14 that makes possible the display of images in undistorted form. Imaging area 14 also offers a more efficient use of the screen area as the corners are relatively square in contrast to the rounded corners of the present-day home entertainment cathode ray tube.

Figure 2:
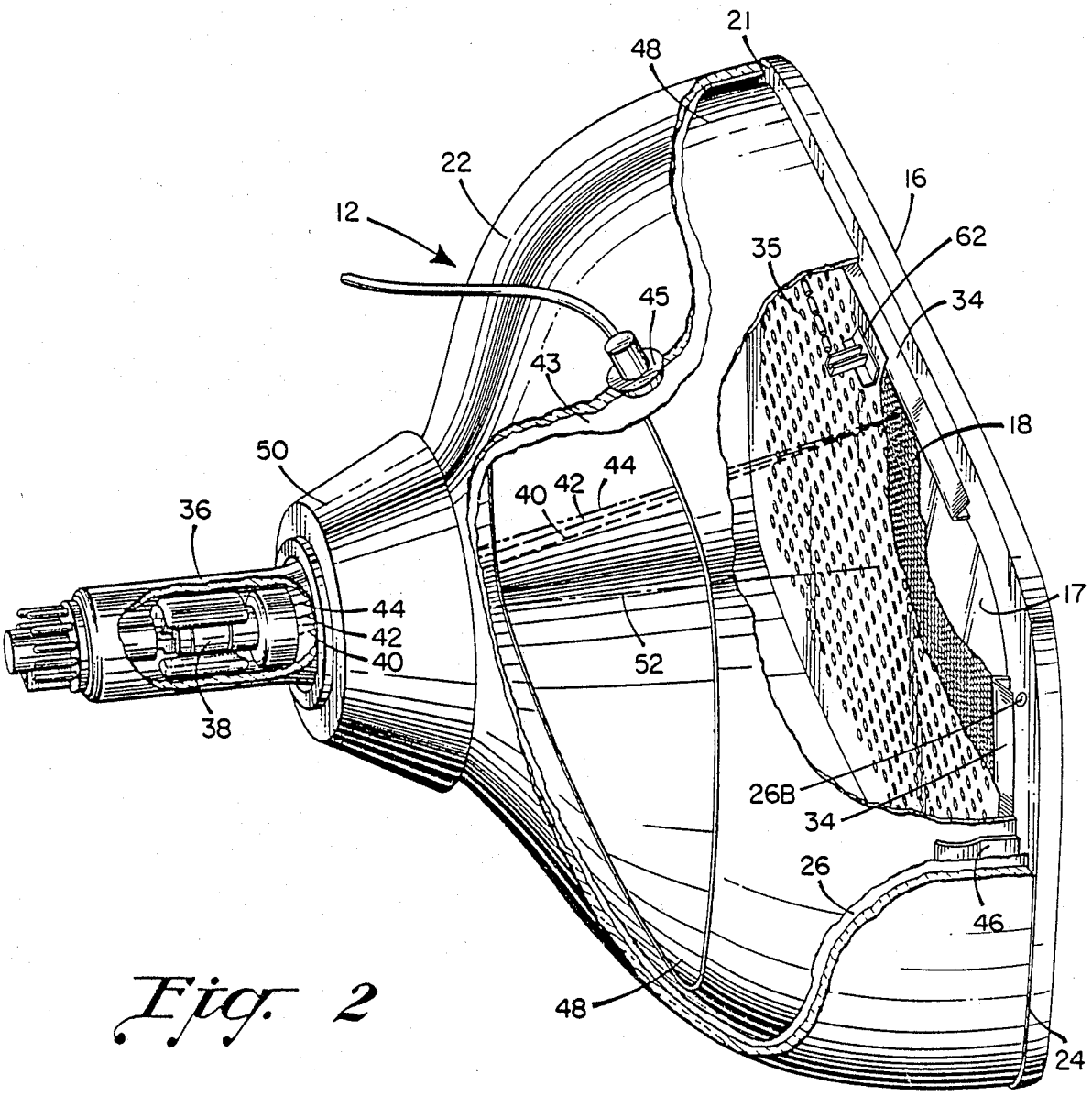
FIG. 2 is a side view in perspective of the color cathode ray tube of FIG. 1 showing another view of the components depicted in FIG. 1 together with cut-away sections that indicate the location of vibration damping means of the invention.
Figure 3:
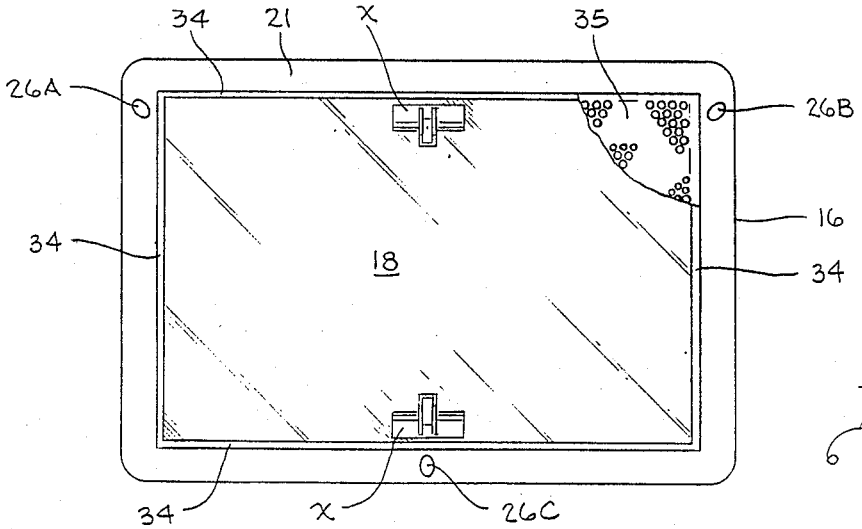
FIG. 3 is a plan view schematically showing one location of the vibration damping means to the inner surface of the cathode ray tube faceplate shown by FIG. 2.
Figure 4:
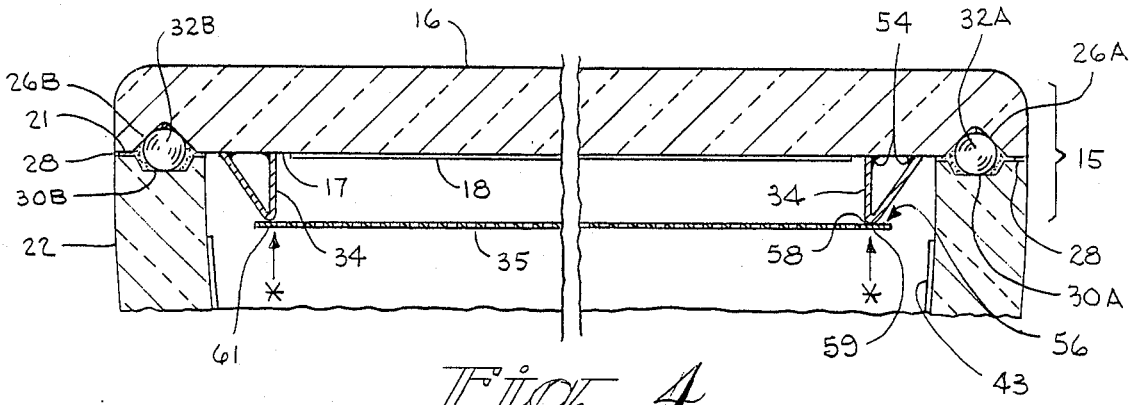
FIG. 4 is a view in elevation of a section of the front assembly and associated tube funnel.

With reference also to FIGS. 2, 3 and 4, a front assembly 15 is depicted and includes a glass faceplate 16 noted as being flat, or alternately, "substantially flat," in that it may have finite horizontal and vertical radii, for example. Faceplate 16, depicted as being flangeless, is indicated as having on its inner surface 17 a centrally disposed phosphor screen 18 on which is deposited an electrically conductive film (not shown), typically composed of aluminum. The phosphor screen 18 and the conductive film comprise the electron beam target area.

Screen 18 is shown as being surrounded by a peripheral sealing area 21 adapted to be mated with a funnel 22. Sealing area 21 has, by way of example, three cavities: 26A, 26B and 26C therein. The cavities provide, in conjunction with complementary rounded indexing means, for indexing faceplate 16 with funnel 22.

Funnel 22 has a funnel-sealing area 28 with second indexing elements 30A, 30B and 30C therein in orientation alike to indexing elements 26A, 26B and 26C. Indexing elements 30A and 30B are depicted in FIG. 4 as being V-grooves in facing adjacency with the cavities 26A and 26B. (Indexing elements 30C and 26C are similarly located.) The V-grooves of indexing elements 30A, 30B and 30C are preferably radially oriented, and the indexing elements are preferably located at 120 degree intervals in the funnel-sealing area 28. Ball means 32A, 32B and 32C, which provide the aforedescribed complementary rounded indexing means, are conjugate with the indexing elements 26A, 26B and 26C, and 32A, 32B and 32C for registering faceplate 16 and funnel 22. The indexing means set forth in the foregoing and their application to the foil tension mask technology is described and claimed in referent copending applications Ser. Nos. 572,088 (now U.S. Pat. No. 4,547,696); 572,089; 727,486 (now U.S. Pat. No. 4,695,523); 729,015; 754,786 (now U.S. Pat. No. 4,672,260); 754,787 (now U.S. Pat. No. 4,712,041); 758,174 (now U.S. Pat. No. 4,713,034) 831,697 (now U.S. Pat. No. 4,692,660); and in U.S. Pat. No. 4,547,696 to Strauss, all of common ownership herewith.

Front assembly 15 includes a tension foil shadow mask support structure 34, noted as being in the form of a frame secured to the inner surface 17 of faceplate 16 between the centrally disposed screen 18 and the peripheral sealing area 21 of faceplate 16, and enclosing screen 18. The shadow mask support structure 34 is preferably composed of sheet metal, and is secured to the inner surface 17 on opposed sides of screen 18, as indicated by FIG. 4. A foil shadow mask 35 is secured in tension on structure 34 at the locations indicated by asterisks in FIG. 4. Details of shadow mask support structure 34 can be derived from copending application Ser. No. 532,556 of common ownership herewith.

As seen in FIGS. 1 and 2, a neck 36 extending from funnel 22 is represented as enclosing an electron gun 38 which is portrayed as emitting three electron beams 40, 42 and 44. The three beams serve to selectively excite to luminescence the phosphor deposits on the screen 18 after passing through the parallax barrier formed by shadow mask 35.

Funnel 22 is indicated as having an internal electrically conductive funnel coating 43 adapted to receive a high electrical potential. The potential is depicted as being applied through an anode button 45 attached to a conductor 47 which conducts a high electrical potential to the anode button 45, which projects through the wall of funnel 22. The source of the potential is a high-voltage power supply (not shown). The potential may be, for example, in the range of 18 to 30 kilovolts, depending upon the type and size of cathode ray tube. Means for providing an electrical connection between the sheet metal frame 34 and the funnel coating 43 may comprise spring means 46, as depicted in FIG. 2. An internal magnetic shield 48 provides shielding for the electron beam excursion area and the front assembly 15 from the influence of stray magnetic fields. A yoke 50 is shown as encircling tube 12 in the region of the junction between funnel 22 and neck 36. Yoke 50 provides for the electromagnetic scanning of beams 40, 42 and 44 across the screen 18. The center axis 52 of tube 12 is indicated by the broken line. Items designated as "radially extending" extend radially outwardly from this axis.

The above description of the video monitor, color cathode ray tube and shadow mask has been presented for exemplary purposes to illustrate one application of the vibration damping means of the invention. However, it should be understood that the invention is readily applicable for any color selection electrode other than a "shadow mask."

Figure 5:
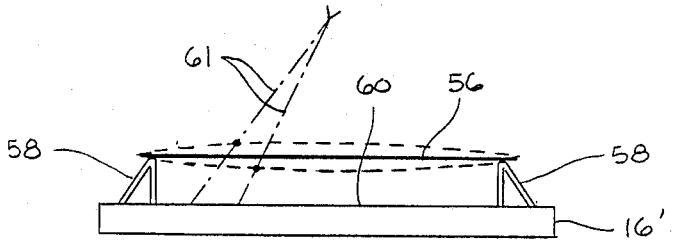
FIG. 5 is a schematic illustration of a vibration mode of a flat color selection electrode.

In essence, a shadow mask of a color cathode ray tube or other color selection electrode of the type with which this invention is concerned comprises a rectangular membrane suspended in high vacuum under high mechanical tension. The mask therefore is capable of vibrating in "membrane modes" which are the two-dimensional equivalent of the vibrations of a stretched string. As illustrated in FIG. 5, a color selection electrode 56 is suspended under high mechanical tension between surrounding support rails 58. The rails are fixed to a glass faceplate 16' which is part of the glass envelope for the color cathode ray tube. A color phosphor screen or layer is formed on the inner surface of panel 16', as at 60. The electron beam emitted from the electron gun of the cathode ray tube passes through color selection electrode 56 for impingement upon phosphor screen 60.

FIG. 5 illustrates, in dotted lines, the resonant vibration of color selection electrode 56 as observed along a horizontal or vertical center line. It is apparent that the most prominent membrane mode is the fundamental one shown in FIG. 5, with maximum amplitude in the center of the electrode. Such vibration causes incorrect electron beam interception by the electrode. The resulting "landing errors" are most prominent at two points on the horizontal center line located approximately 55% of the distance from the center to the edge of both sides of the electrode, as indicated by lines 61. For instance, for a mask deflection of one mil at the center of mask 56, the landing errors at the two worst points are approximately 0.26 mils. In high resolution color cathode ray tubes, such resulting landing errors are not acceptable. Because of the absence of damping in high vacuum, the electrode, once excited by any kind of shock, may vibrate for a period of one minute or longer, corresponding to a "Q" in the order of 100,000.

The amplitude of vibration of the electrode at points other than the center of the mask is a sinusoidal function of position. There may also be a problem with one of the first overtones. For instance, the frequency of the fundamental mode may be approximately 500 Hz. The first horizontal overtone (with a vertical nodal line) may be at approximately 750 Hz.

Figure 3A:
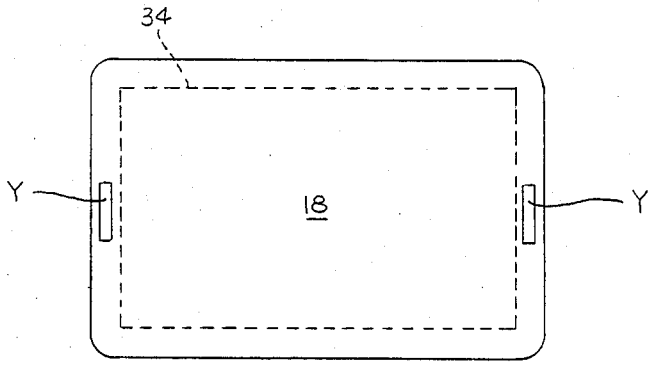
FIG. 3A is a schematic showing of another location of the vibration damping means.

FIGS. 3 and 3A show schematic locations for the electrode vibration damping means of the invention. In FIG. 3, the damping means are shown located intermediate the ends of the "long" sides of the color selection electrode, as at "X", the region of maximum peripheral motion for the fundamental mode and the first vertical overtone. FIG. 3A shows the location of the damping means intermediate the ends of the "short" sides of the color selection electrode, as at "Y", the region of maximum peripheral motion for the first horizontal overtone.

Briefly, the invention contemplates in one preferred embodiment an improved color selection electrode damping system incorporating a dynamic vibration damper which avoids frequency tracking problems by using the electrode tension to determine the resonant frequency not only of the electrode but also of the damper device. The damper includes rigid means secured to the edge of the tensed electrode and dissipative or resistive means connected to the rigid means and spaced from the tensed electrode. In this preferred embodiment, resistive loading of the rigid means is achieved by lossy flexural means. In essence, the system involves the use of coupled resonators.

Figure 6:
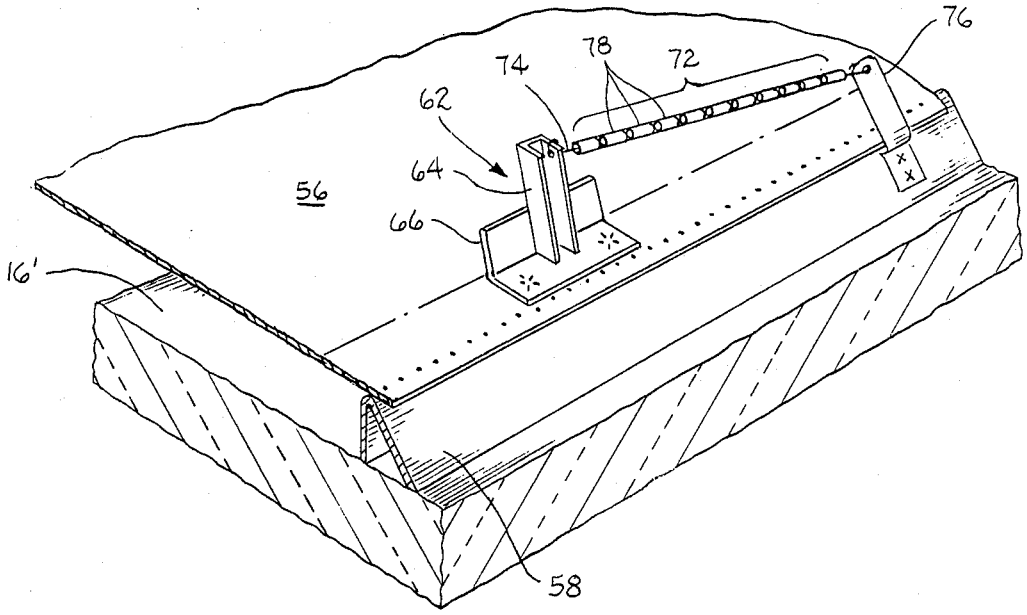
FIG. 6 is a perspective view of one form of device for carrying out the concepts of the invention.

More particularly, FIG. 6 shows one possible construction of the coupled resonator vibration damping means, generally designated 62, of the invention which includes a channel-shaped elongated member in the form of a bar 64 for amplifying the vibration in the electrode 56. Bar 64 is secured to a bracket 66 which, in turn, is secured to tensed color selection electrode 56 on the marginal portion of the electrode, immediately inside supporting rail 58. Bracket 66 is in the form of an angle-bracket to provide rigid support for rigid channel-shaped bar 64. The bracket preferably is fabricated of relatively heavy metal material, such as 0.020 inch steel, so as not to flex. Bar 64 is made of thinner material such as 0.015 inch steel in order to reduce its moment of inertia, but it is channel-shaped to optimize its flexural rigidity. The bracket 66 may be spot welded to electrode 56, with the bar 64 spot welded to the bracket, or a one-piece construction may be provided. The two-piece construction shown may be preferred because the projecting bar may make handling of the electrode during photoscreening of the cathode ray tube more difficult. Making bar 64 and bracket 66 rigid, i.e., keeping their compliance negligible compared to the compliance of electrode 56 to which the means 62 is secured, ensures frequency tracking when the electrode tension changes, as will now be described.

It can be noted in FIG. 6 that bracket 66 and the attached channel-shaped bar 64 are angled relative to the faceplate in order to accommodate a magnetic shield which will be mounted on rail 58 over the color selection electrode. The angle must not be too great so as not to interfere with the electron beams as they are scanned to the edge of the screen. In addition, it can be seen that bracket 66 has a low profile versus the higher bar 64. The bracket is deliberately kept low in profile because it is attached to the electrode before it goes through the screen exposure process steps. A tall bracket could catch on an operator's clothing or otherwise cause interference. Therefore, the bar is welded to the bracket after all screening operations are completed. In this manner, amplification of vibration is achieved without having a high bracket throughout the screening processing.

Figure 7:
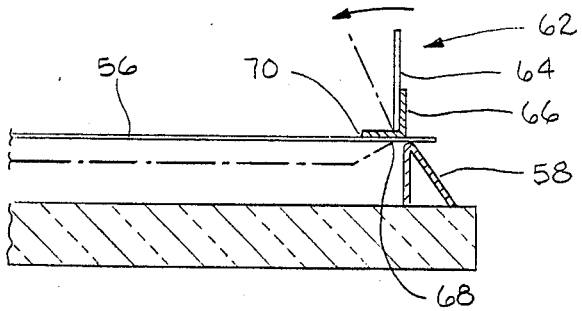
FIG. 7 is a schematic illustration of how the vibration damping means of the invention functions.

FIG. 7 illustrates schematically the condition when a moment is applied to rigid means 62 (here shown as bracket 66 and bar 64). The bar and bracket remain rigid and rotate together about axis of rotation 68, while electrode 56 stretches to permit such rotation. The angular stiffness, defined as the applied moment divided by the angular displacement, is a function of the size and shape of the bracket support area (i.e., the area defined by the spot welds between the bracket and the electrode), and also is proportional to the tension in electrode 56. The resonant frequency of angular vibration of bar 64 and bracket 66 about axis 68 is therefore proportional to the square root of the electrode tension. This same relationship, however, is true for the resonant frequency of the electrode itself. Consequently, as the tension relaxes when the electrode is heated by the electron beam during tube operation, the resonant frequencies of the electrode and the bar decrease at the same rate, and frequency tracking is ensured.

How the bracket-bar assembly 62 functions as a dynamic vibration damper for a selected resonant mode, e.g., the fundamental membrane mode of electrode 56, will now be explained.

If assembly 62 were held in a fixed position, vibration of the electrode would result in the portion of the electrode adjacent to bracket edge 70 (FIG. 7) moving u and down while turning about edge 70 as its axis. Since the electrode is under tension, it would exert an alternating force upon assembly 62, attempting to set it into angular vibration.

Conversely, if the electrode were held in a fixed position at its center, angular vibration of assembly 62 would displace edge 70 up and down, attempting to set electrode 56 into vibration. Electrode 56 and assembly 62 thus represent two coupled resonators. As previously stated, their resonant frequencies are made substantially alike. As is well-known, a pair of coupled resonators exhibits two new resonant frequencies; for an experimental structure consisting of electrode 56 and barbracket assembly 62 as described, each separately resonant at 70 Hz, the two coupled resonances were observed to occur at 447 Hz and 494 Hz.

In a system of two coupled resonators, energy originally present in one resonator is rapidly transmitted to the other, and the entire system can be damped by applying damping to just one of the resonators. Assembly 62 functions to extract vibratory energy from electrode 56 and render it accessible to resistive means 72 (FIG. 6) wherein it may be dissipated.

In the preferred embodiment, the resistive means 72 includes flexural means for applying resistive damping to bar 64. The flexural means is capable of propagating energy in the form of flexural waves. In an environment where viscous liquids or eddy current damping devices cannot be used, such as in the vacuum environment of a color cathode ray tube, it is difficult to produce a well-defined mechanical resistance. However, the invention illustrates various forms of suitable flexural means such as that shown in FIG. 6. More particularly, a flexural wave transmission line 74, such as a wire or a thin, flat strip, is connected between bar 64 and a support 76. The wire preferably may be stranded in order to provide increased flexibility as well as internal frictional resistance. The propagation velocity of flexural waves in a given wire or strip is proportional to the square root of frequency, and it decreases as flexibility increases. Low propagation velocity is desirable because, to obtain sufficient damping, the transmission line should be approximately 2–4 wavelengths long. To allow convenient placement of the line inside a cathode ray tube, the wavelength should therefore not exceed 2–3 inches. At 500 Hz this requires a maximum propagation velocity of 1,000–1,500 inches per second. In practice, a stainless steel wire rope which is stranded with seven strands of 0.011 inch wire has been used successfully. The wire is attached to the top of bar 64 by a small flexible clip made of 0.005 inch thick steel. Its measured propagation velocity at 470 Hz is approximately 25 meters (1,000 inches) per second.

It has been found that if wire 74 is made approximately 40 inches long, its natural losses (presumably friction between strands) suffice to provide the desired resistive behavior: A flexural wave at 400–500 Hz, launched at one end and reflected from the other, is sufficiently attenuated upon its return to the launching end to make the mechanical impedance of the line substantially resistive, equal to its characteristic impedance which is the product of flexural wave velocity and mass per unit length. However, the same effect can be obtained with a six-inch wire (approximately three wavelengths long) by loosely stringing light objects upon the wire. When the wire vibrates in flexure, these objects rattle and thereby extract energy from the vibration, converting it to random vibrations and eventually into heat, resulting in damping the bar 64 and electrode 56 vibrationally coupled thereto.

FIG. 6 shows one embodiment wherein steel bushings 78 are strung on wire 74, with some clearance between the bushings so that they can vibrate freely. The resulting damping action has been found to be indistinguishable from that observed when the wire was loosely wrapped with sound-absorbent textile or paper-based material which, of course, cannot be used in a cathode ray tube. When the electrode is caused to vibrate in its lowest frequency mode by a brief driving pulse, the time constant of amplitude decay is on the order of 20 milliseconds. In actual practice, 23 steel bushings, ¼ inch long, having 0.040 inch I.D. and 0.078 inch O.D. were strung on the stranded wire 74.

Figure 8:
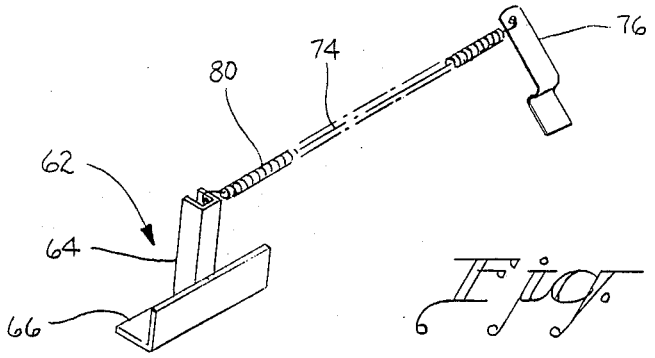
FIGS. 8–16 are perspective views of other forms of devices for carrying out the concepts of the invention.

FIG. 8 illustrates another embodiment wherein a coil spring 80 is positioned in loose surrounding relationship about wire 74. Such a spring can also be used for vibration damping and may have advantages, from a manufacturing standpoint, over multiple small parts such as bushings 78.

Figure 9:
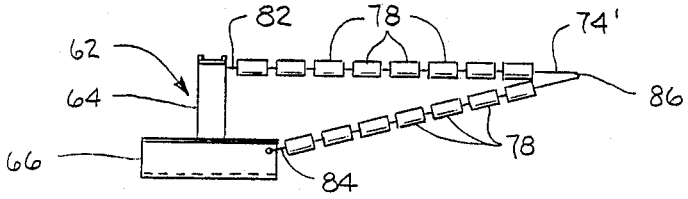

There may be instances wherein it is impractical to place a supporting bar 76 at a corner of the cathode ray tube envelope. FIG. 9 shows an alternate form of the invention wherein wire 74' is doubled-back toward means 62 whereby one end 82 of the flexural transmission line is secured to the top of bar 64, and an opposite end 84 of the line is secured to bracket 66. The line is folded back onto itself, as at 86. Again, loose objects, such as bushings 78, are strung along both portions of the line which may be shaped as a triangle, as shown. The transmission line thereby becomes self-supporting.

Figure 10:
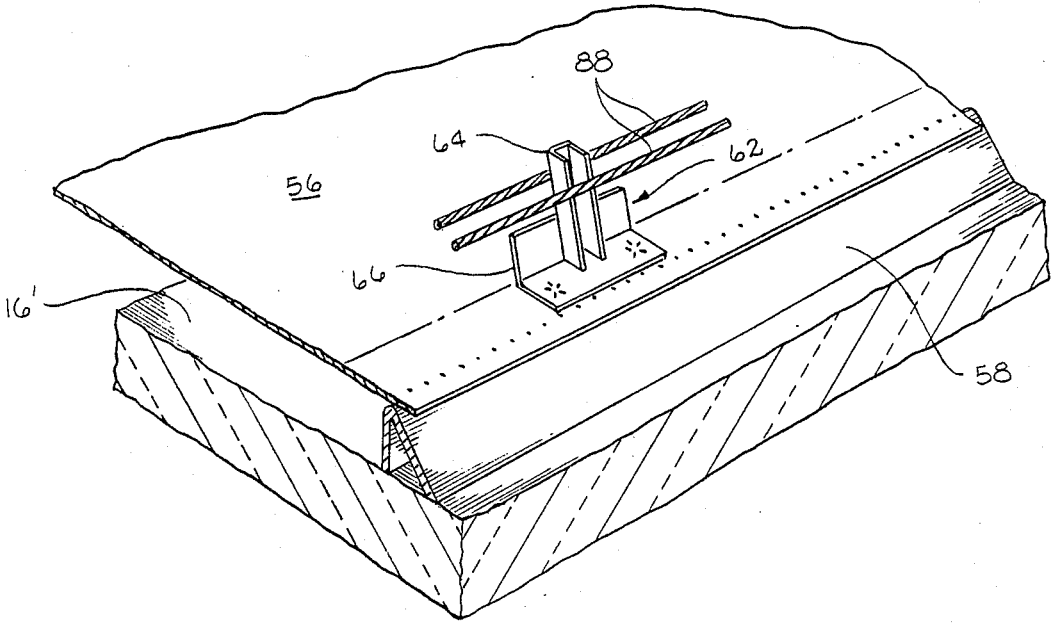
Figure 10A:
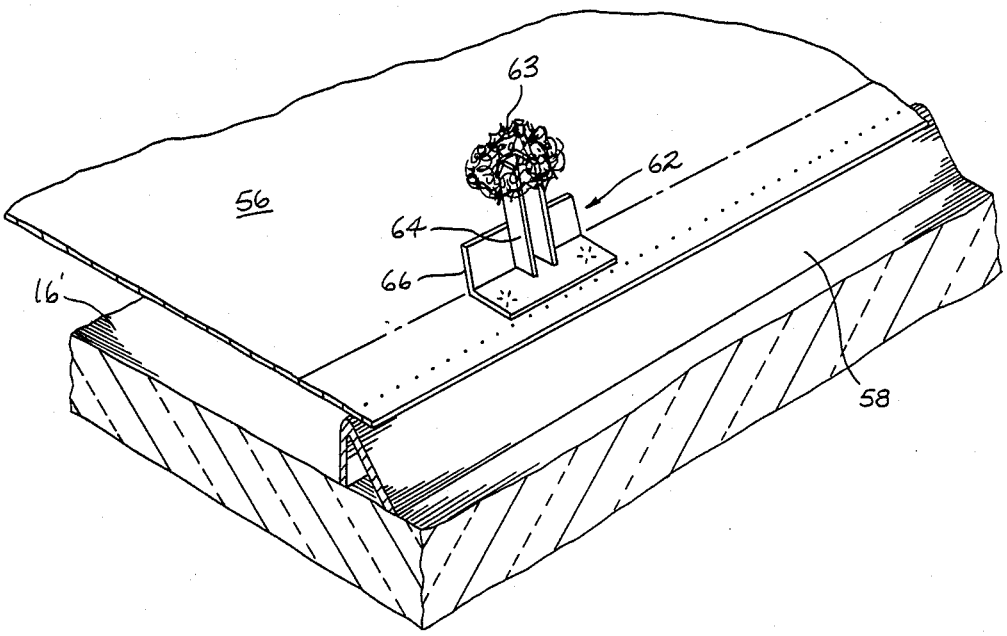

FIG. 10 shows another embodiment of a coupled resonator system of the invention wherein, instead of using a lossy flexural transmission line, the vibration damping means comprises a flexurally resonant stranded wire. Two stranded wires 88 are shown secured to opposite sides of bar 64. As is known, stranded wire i much more flexible than solid wire of the same cross-section. When stranded wire flexes, the individual strands slide against each other, causing friction which extracts vibratory energy, and thereby provides damping. Dimensioning the wire to be at least approximately resonant increases its amplitude and facilitates energy loss. Alternatively, a lossy fibrous mass 63 may be attached to bar 64 to provide damping. See FIG. 10A.

Figure 11:
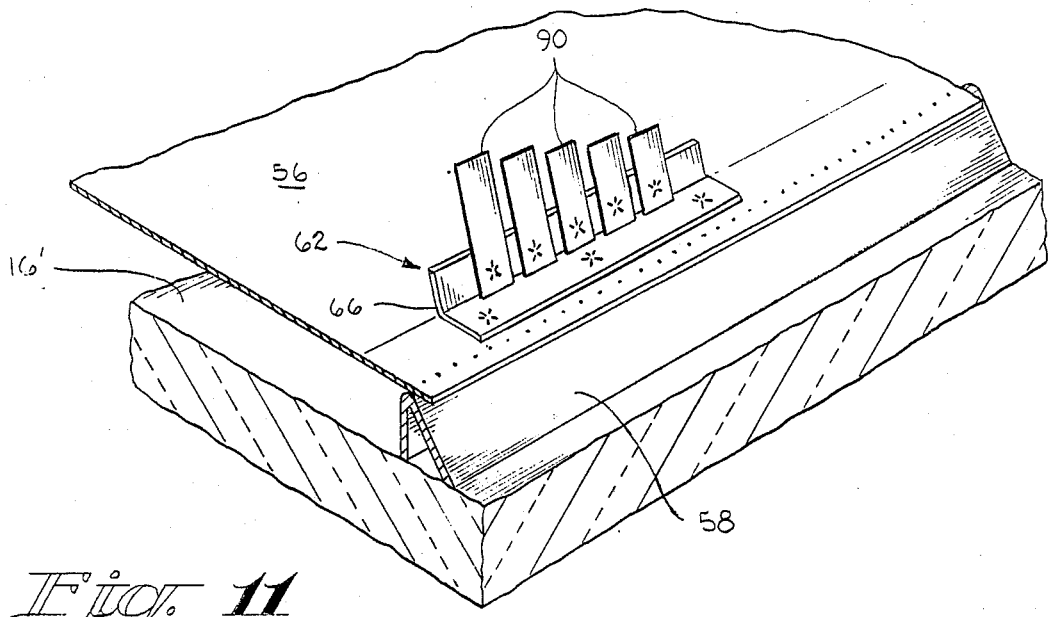

FIG. 11 shows another embodiment of the invention wherein a plurality of resonators are provided which resonate at different frequencies with the range of frequencies at which electrode 56 is expected to resonate as it heats up during tube operation. Specifically, a plurality of compliant reeds 90 are secured to bracket 66. As a reed bends as it vibrates, the bending of the lossy material extracts energy from the system. The compliance of the reeds, in combination with the compliance provided by the electrode, establish different resonant frequencies for the different reeds. The reeds can be of different lengths, as shown, and/or of different thicknesses to resonate at different frequencies. The reeds should be at least somewhat lossy. For example, they may be made of pure magnesium which is known to have vibration-damping properties.

Figure 12:
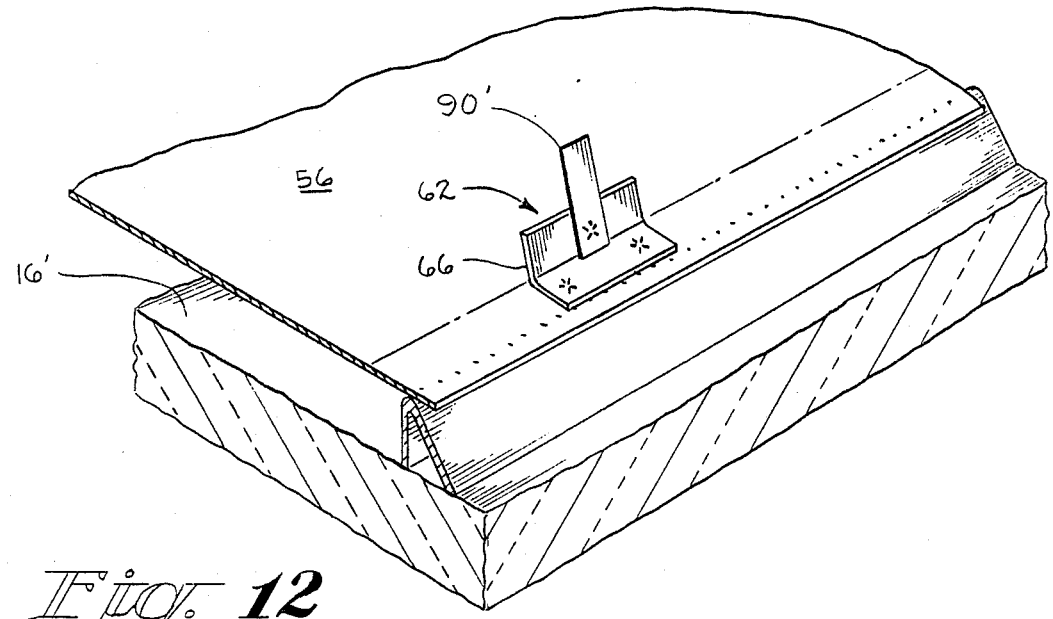

Whereas the embodiment of FIG. 6 provides a self-tracking system, as described, with excellent damping regardless of frequency, FIG. 12 shows a version which will not track electrode resonance changes, but is simple and employs a single lossy, compliant reed resonator 90'. This version offers the advantages of low cost and easy execution.

It should be noted that the resonant frequency of reed 90' is determined by the effective mass of the reed in combination with its total compliance, i.e., the sum of the compliances of the reed itself and the compliance prevailing at bracket 66 on which the reed is mounted. The latter compliance varies inversely with the tension of electrode 56. Therefore, the resonant frequency of reed 90', while unable to track the temperature-engendered variations of the resonant frequency of electrode 56 completely, it follows these variations at least in part.

Figure 13:
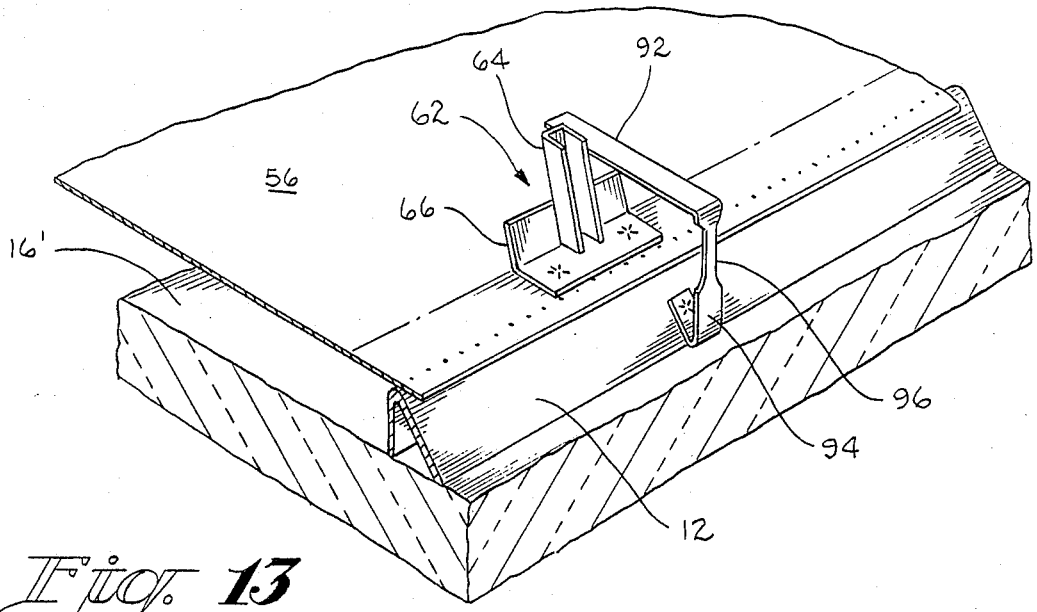

FIG. 13 shows an embodiment of the invention wherein, instead of using a mechanical transmission line, a lossy reed or the like, a form of "friction brake" 92 is used to extract energy from the system by a rubbing action. The friction brake must be detuned, i.e., it does not resonate with bracket 66 and bar 64. The brake is secured to rail 12, as at 94, and includes a torsional spring portion 96. Friction between bar 64 and brake 92 is controlled by the torsional spring portion and will extract energy from the system.

Figure 14:
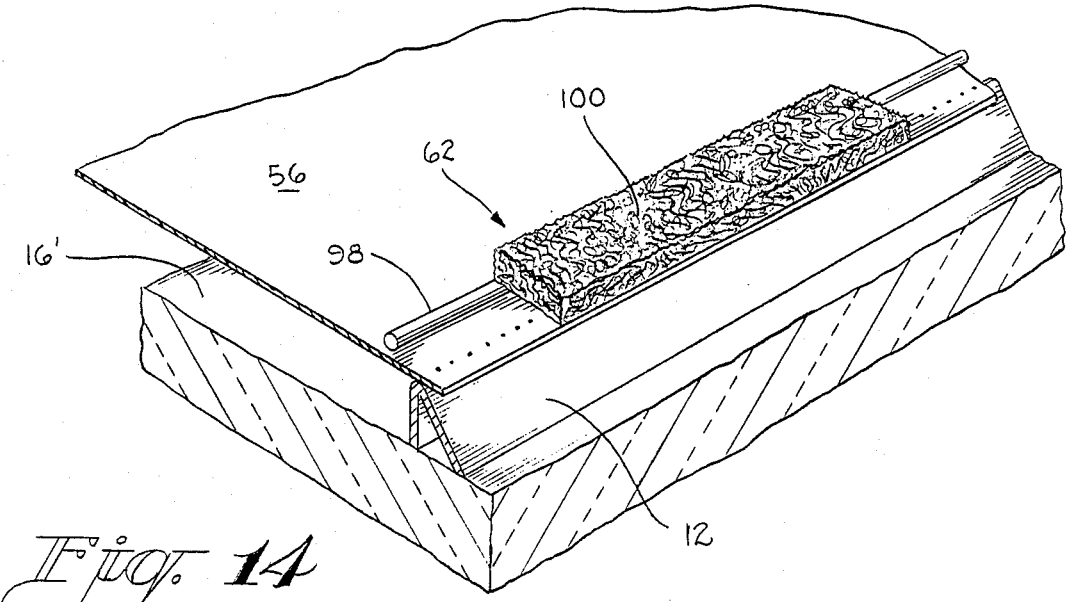

FIG. 14 shows another embodiment of the invention, again using the coupled resonator principles. A relatively massive rod or wire 98 is welded to the peripheral portion near the apertured area of the electrode. Wire 98 provides mass to the vibration damping means the same as bracket 66 described above. By properly selecting the mass of the wire, the wire can be set into resonance at the same resonant frequency as electrode 56. Since the electrode tension provides the compliance for both the electrode resonance and the resonance of the wire, this system also will have the frequency tracking feature. To extract energy from the system, an overlaid braid 100 is provided. The braid is not secured to the wire but vibrates or "rattles" against it. The braid can be welded to the electrode near the weld line of the electrode to rail 12.

Figure 15:
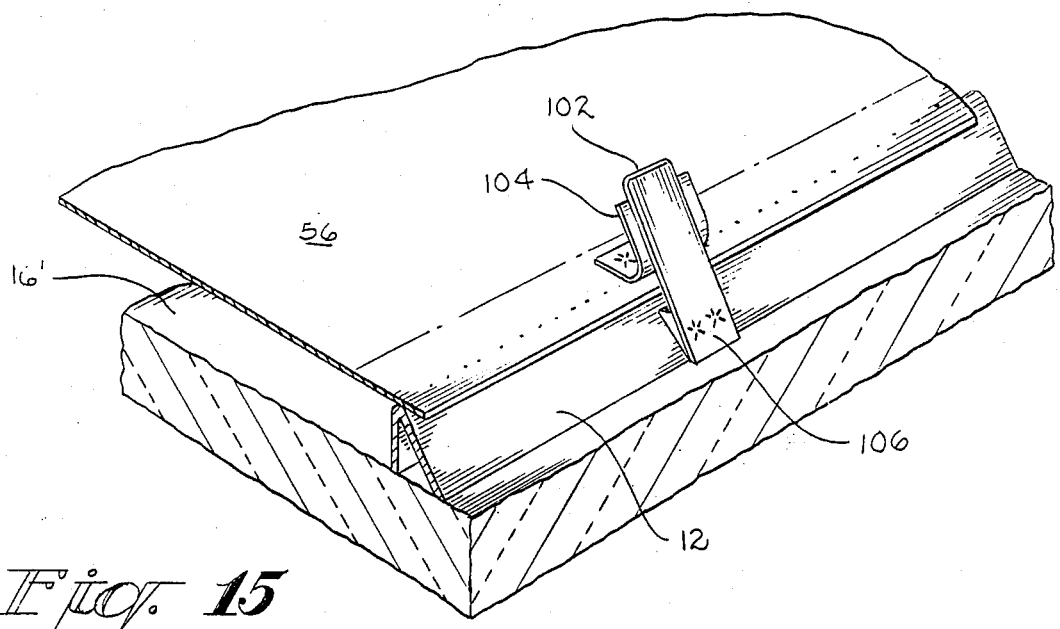

FIG. 15 shows an embodiment of the invention wherein electrode 56 is coupled to a lossy reed resonator 102 by means of a weak, bent leaf spring 104. The reed is not mounted on electrode 56 but on rail 12, as shown at 106. Operation of this embodiment is analogous to that described in connection with FIG. 12, except that the resonant frequency of reed 102 does not track that of electrode 56 even in part.

Figure 16:
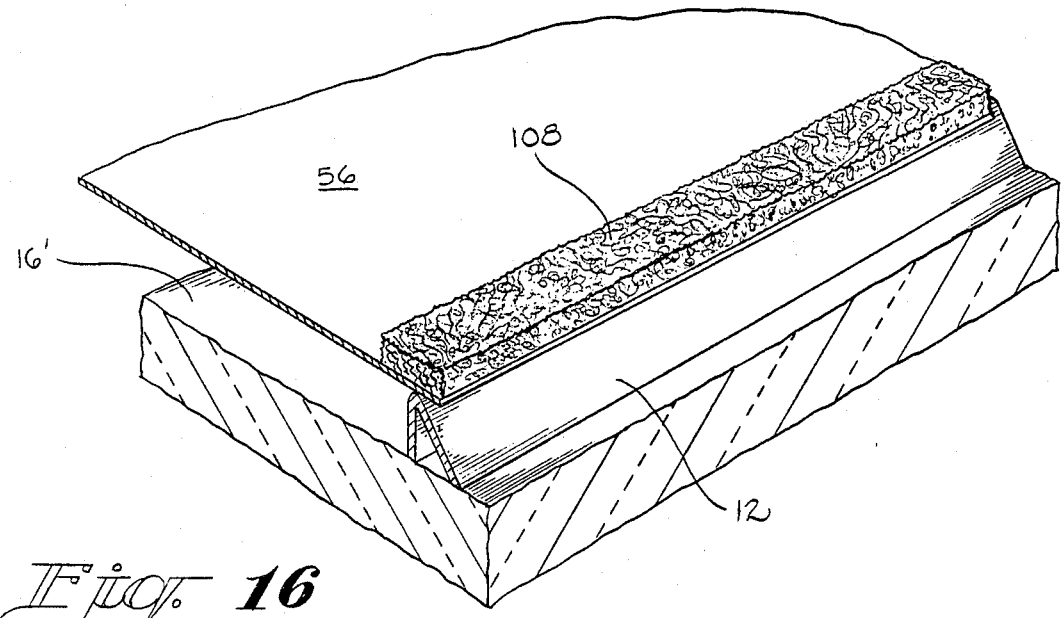

Lastly, FIG. 16 shows a simple embodiment of the invention wherein a simple energy absorber 108 is secured along the peripheral portion of electrode 56 to damp vibrations in the electrode. The energy absorber can be of braided material, for instance.

It will be appreciated that numerous modifications in the described embodiments of the invention will be apparent to those skilled in the art without departing from its true spirit and scope. For example, damping of a resonator by resonant stranded wires (FIG. 10), friction (FIG. 13) or contact with a braid (FIG. 14) may be used in embodiments other than those where it is illustrated. The invention is to be limited only as defined in the claims.

What is claimed is:

1. In a flat tension mask color cathode ray tube having a flat rectangular faceplate, a flat rectangular color selection electrode and support means for supporting said electrode in tension, said electrode having a central apertured portion and a peripheral portion located between said apertured portion and the junction of said electrode with said support means, said electrode being susceptible to vibration with respect to said support means resulting in color purity errors in reproduced images; and lossy vibration damping means secured to said peripheral portion of said electrode for damping vibrations in said electrode.

2. In a flat tension mask color cathode ray tube having a flat rectangular faceplate, a flat rectangular color selection electrode and support means for supporting said electrode in tension, said electrode having a central apertured portion and a peripheral portion located between said apertured portion and the junction of said support means, said electrode being susceptible to vibration with respect to said support means resulting in color purity errors in reproduced images; and lossy vibration damping means for damping vibrations in said electrode, said damping means being secured to a part of said peripheral portion of said electrode selectively at a location of maximum vibrational amplitude for the fundamental vibration frequency of said electrode.

3. In a flat tension mask cathode ray tube having a flat rectangular faceplate, a flat rectangular color selection electrode and support means for supporting said electrode in tension, said electrode having a central apertured portion and a peripheral portion located between said apertured portion and the junction of said electrode and said support means, said electrode being susceptible to vibration with respect to said support means resulting in color purity error in reproduced images; and lossy vibration damping means for damping vibrations in said electrode, said damping means secured to a part of said peripheral portion of said electrode selectively at a location of maximum vibrational amplitude for one of the first vibration frequency overtones of said electrode.

4. In a flat tension mask color cathode ray tube having a flat rectangular faceplate, a flat rectangular color selection electrode and support means for supporting said electrode in tension on said faceplate, said electrode having a central apertured portion and a peripheral portion located between said apertured portion and the junction of said electrode with said support area, said electrode being susceptible to vibration with respect to said support means; and vibration damping means for damping vibrations in said electrode, said damping means being secured to said peripheral portion of said electrode on or near the minor axis of the electrode so as to damp the fundamental and one overtone vibration frequency of said electrode.

5. In a tension mask color cathode ray tube having a faceplate, a color selection electrode and support means for supporting said electrode in tension, said electrode having a central apertured portion and a peripheral portion located between said apertured portion and the junction of said electrode with said support means, said electrode being susceptible to vibration with respect to said support means; and vibration damping means secured to said peripheral portion of said electrode for damping vibrations in said electrode, said damping means comprising energy absorbing means and means for transferring vibrational energy derived from said electrode to said energy absorbing means.

6. In a tension mask color cathode ray tube defined by claim 5 wherein said energy absorbing means comprises a metal braid.

7. In a tension mask color cathode ray tube having a faceplate, a color selection electrode and support means for supporting said electrode in tension on said faceplate, said electrode having a central apertured portion and a peripheral portion located between said apertured portion and the junction of said electrode with said support means, said electrode being susceptible to vibration with respect to said support means; and vibration damping means secured to said peripheral portion of said electrode for damping vibrations in said electrode, said damping means comprising a lossy flexural mechanical transmission line and coupling means for coupling said transmission line to said electrode.

8. In a tension mask color cathode ray tube defined by claim 7 wherein transmission line comprises a wire rope on which is loosely strung a plurality of beads.

9. In a tension mask color cathode ray tube wherein said transmission line comprises a wire rope threaded through a coil spring.

10. In a tension mask color cathode ray tube having a faceplate with a target area, a color selection electrode and support means for supporting said electrode in tension, said electrode having a central apertured portion and a peripheral portion located between said apertured portion and the junction of said electrode with said support means, said electrode being susceptible to vibration independently of said support means at different fundamental resonant frequencies dependent on its tension; and vibration damping means secured to said peripheral portion of said electrode for damping vibrations in said electrode, said damping means further comprising a plurality of damped resonators, each resonating at a different frequency related to a different fundamental resonant frequency of said electrode.

11. In a tension mask color cathode ray tube having a faceplate, a color selection electrode and support means for supporting said electrode in tension on said faceplate, said electrode having a central apertured portion and a peripheral portion located between said apertured portion and the junction of said electrode with said support means, said electrode being susceptible to vibration with respect to said support means; and vibration damping means secured to said peripheral portion of said electrode for damping vibrations in said electrode, said damping means comprising an energy absorbing means supported in spaced relation to said electrode by a rigid element.

12. In a tension mask color cathode ray tube defined by claim 11 wherein said energy absorbing means comprises a lossy flexural mechanical transmission line.

13. In a tension mask color cathode ray tube defined by claim 12 wherein said transmission line comprises a wire rope on which is loosely strung a plurality of beads.

14. In a tension mask color cathode ray tube defined by claim 12 wherein said transmission line comprises a wire rope threaded through a coil spring.

15. In a tension mask color cathode ray tube defined by claim 11 wherein said vibration damping means include a lossy reed.

16. In a tension mask color cathode ray tube defined by claim 11 wherein said energy absorbing means comprises a lossy fibrous mass.

17. In a tension mask color cathode ray tube having a faceplate, a color selection electrode and support means for supporting said electrode in tension, said electrode having a central apertured portion and a peripheral portion located between said apertured portion and the junction of said electrode with said support means, said electrode being susceptible to resonant vibration with respect to said support means, and resonant vibration damping means secured to said peripheral portion of said electrode to form a damped system of coupled resonators for damping vibrations in said electrode.

18. In a tension mask color cathode ray tube, a color selection electrode and support means for supporting said electrode in tension, said electrode being susceptible to resonant vibration with respect to said support means, said electrode having a central apertured portion and a peripheral portion located between said apertured portion and the junction of said electrode with said support means, and resonant vibration damping means forming, together with said electrode, a damped system of coupled resonators for damping vibrations in said electrode, said vibration damping means including an element secured directly to said peripheral portion of said electrode and energy absorbing means for extracting vibrational energy therefrom, the tension in said electrode controlling the resonant frequency of both said element and said electrode, thereby assuring damping despite changes in the tension in said electrode.

19. In a tension mask color cathode ray tube defined by claim 18 wherein said element comprises a bracket means and wherein said energy absorbing means comprises a lossy fibrous mass affixed to said bracket means.

20. In a tension mask color cathode ray tube defined by claim 18 wherein said element comprises a bracket means and wherein said energy absorbing means comprises a lossy flexural mechanical transmission line affixed to said bracket means.

21. In a tension mask color cathode ray tube defined by claim 20 wherein said transmission line comprises a wire rope on which is loosely strung a plurality of beads.

22. In a tension mask color cathode ray tube defined by claim 20 wherein said transmission line comprises a wire rope threaded through a coil spring.

23. In a tension mask color cathode ray tube having a faceplate, a color selection electrode and support means for supporting said electrode in tension on said faceplate, said electrode being susceptible to resonant vibration with respect to said support means, said electrode having a central apertured portion and a peripheral portion located between said apertured portion and the junction of said electrode with said support means, and resonant vibration damping means secured to said peripheral portion of said electrode to form a damped system of coupled resonators for damping vibrations in said electrode, said vibration damping means comprising a resonator in the form of a lossy reed coupled to said electrode such as to be set into resonant vibration with said electrode when said electrode vibrates, said lossy reed extracting vibrational energy from said system.

24. In a tension mask color cathode ray tube having a faceplate, a color selection electrode and support means for supporting said electrode in tension on said faceplate, said electrode being susceptible to resonant vibration with respect to said support means, said electrode having a central apertured portion and a peripheral portion located between said apertured portion and the junction of said electrode with said support means, and resonant vibration damping means secured to said peripheral portion of said electrode to form a damped system of coupled resonators for damping vibrations in said electrode, said vibration damping means including a resonator spaced from said electrode and coupled to said electrode by elastic coupling means such as to be set into resonant vibration when said electrode vibrates, said vibration damping means including energy absorbing means for extracting vibrational energy therefrom.

25. In a tension mask color cathode ray tube having a faceplate, a color selection electrode and support means for supporting said electrode in tension on said faceplate, said electrode having a central apertured portion and a peripheral portion located between said apertured portion and the portion of said electrode with said support means, said electrode being susceptible to vibration with respect to said support means; and vibration damping means secured to said peripheral portion of said electrode for damping vibrations in said electrode, said vibration damping means being coupled to said electrode to form a damped coupled resonator system, a first vibratory component of said system being said electrode and a second vibratory component thereof comprising an element secured to said peripheral portion of said electrode, said second component being constructed and arranged to have a resonant frequency which approximates the resonant frequency of said electrode, said system including energy absorbing means within or coupled to said second vibratory component to damp vibrations in said second component whereby vibrational energy in said electrode is coupled to said second vibratory component and extracted from said system by said energy absorbing means.

26. In a tension mask color cathode ray tube having a faceplate, a color selection electrode and support means for supporting said electrode in tension on said faceplate, said electrode having a central apertured portion and a peripheral portion located between said apertured portion and the junction of said electrode with said support means, said electrode being susceptible to vibration with respect to said support means; and vibration damping means secured to said peripheral portion of said electrode for damping vibrations in said electrode, said vibration damping means being coupled to said electrode to form a damped coupled resonator system, a first vibratory component of said system being said electrode and a second vibratory component thereof comprising a rigid member secured to said peripheral portion of said electrode, said second component being constructed and arranged to have a resonant frequency which approximates the resonant frequency of said electrode, said system including energy absorbing means coupled to said second vibratory component to damp vibrations in said second component whereby vibrational energy in said electrode is coupled to said second vibratory component and extracted from said system by said energy absorbing means, said energy absorbing means comprising a lossy flexural mechanical transmission line.

27. In a tension mask color cathode ray tube having a faceplate, a color selection electrode and support means for supporting said electrode in tension on said faceplate, said electrode having a central apertured portion and a peripheral portion located between said apertured portion and the junction of said electrode with said support means, said electrode being susceptible to vibration with respect to said support means in a range of vibration frequencies; and vibration damping means secured to said peripheral portion of said electrode for damping vibrations in said electrode, said vibration damping means being coupled to said electrode to form a damped coupled resonator system, a first vibratory component of said system being said electrode and a second vibratory component thereof comprising a member secured to said peripheral portion of said electrode, said second component being constructed and arranged to have a resonant frequency which approximates the resonant frequency of said electrode, said system including energy absorbing means within or coupled to said second vibratory component to damp vibrations in said second component whereby vibrational energy in said electrode is coupled to said second vibratory component and extracted from said system by said energy absorbing means, the tension in said electrode and the mass of said second vibratory component determining at least in part, the vibration frequency of said second vibratory component, the said vibration frequency of both said electrode and said second vibratory component varying in the same direction as the tension in said electrode changes during tube operation due to such causes as heating of the electrode, thus maintaining at least part of the effectiveness of the damping effected by said vibration damping means.

28. In a tension mask color cathode ray tube having a faceplate, color selection electrode and support means for supporting said electrode in tension on said faceplate, said electrode having a central apertured portion and peripheral portion located between said apertured portion and the junction of said electrode with said support means, said mask being susceptible to vibration with respect to said support means in a range of possible fundamental vibration frequencies; and vibration damping means secured to said peripheral portion of said electrode for damping vibrations in said electrode, said vibration damping means being coupled to said electrode to form a damped coupled resonator system, a first vibratory component of said system being said electrode and a second vibratory component thereof comprising a member secured to said peripheral portion of said electrode, said second component being constructed and arranged to have a resonant frequency which approximates the resonant frequency of said electrode, said system including energy absorbing means within or coupled to said second vibratory component to damp vibrations in said second component whereby vibrational energy in said electrode is coupled to said second vibratory component and extracted from said system by said energy absorbing means, said vibration damping means comprising a plurality of damped resonators, each resonator being structured to resonate at a different frequency related to a different electrode resonant frequency in said range of possible vibration frequencies such that as the tension in and the resonant frequency of said electrode varies during tube operation due to the causes such as electrode heating, the effectiveness of said damping will be maintained.

29. In a tension mask color cathode ray tube having a faceplate, a color selection electrode and support means for supporting said electrode in tension on the faceplate, said electrode having a central apertured portion and peripheral portion location between the apertured portion and the junction of said electrode with said support means, said electrode being susceptible to vibration with respect to said support means; and vibration damping means secured to said peripheral portion of said electrode for damping vibrations in said electrode, said vibration damping means being coupled to said electrode to form a damped coupled resonator system, a first vibratory component of said system being said electrode and a second vibratory component thereof comprising a rigid member secured to said peripheral portion of said electrode, said second component being constructed and arranged to have a resonant frequency which approximates the resonant frequency of said electrode, said system including energy absorbing means coupled to said second vibratory component and extracted from said system by said energy absorbing means, said second vibratory component comprising a rigid bracket extending from said electrode which supports said energy absorbing means in spaced relation to said electrode.

30. In a tension mask color cathode ray tube defined by claim 29 wherein said energy absorbing means comprises two stranded wires affixed to said rigid bracket.

31. In a tension mask color cathode ray tube defined by claim 29 wherein said energy absorbing means comprises a flexible member which rubs against said rigid member when said rigid member vibrates.

32. In a tension mask color cathode ray tube having a faceplate, a color selection electrode and support means for supporting said electrode in tension on said faceplate, said electrode being susceptible to vibration with respect to said support means, said electrode having a central apertured portion and a peripheral portion located between said apertured portion and the junction of said electrode with said support means, and resonant vibration damping means secured to said peripheral portion of said electrode to form a damped system of coupled resonators for damping vibrations in said electrode, said vibration damping means including a resonator coupled to said electrode such as to be set into resonant vibration when said electrode vibrates, said vibration damping means including a member which rubs against said resonator when said resonator vibrates to extract by friction vibrational energy from said system.

* * * * *